US012385121B2

(12) United States Patent
Philippot et al.

(10) Patent No.: US 12,385,121 B2
(45) Date of Patent: Aug. 12, 2025

(54) COATED STEEL SHEET AND HIGH STRENGTH PRESS HARDENED STEEL PART AND METHOD OF MANUFACTURING THE SAME

(71) Applicant: ArcelorMittal, Luxembourg (LU)

(72) Inventors: Clément Philippot, Ennery (FR); Alice Dumont, Le Ban St Martin (FR); Deborah Herry, Luppy (FR); Martin Beauvais, Marange Silvange (FR)

(73) Assignee: ArcelorMittal, Luxembourg (LU)

( * ) Notice: Subject to any disclaimer, the term of this patent is extended or adjusted under 35 U.S.C. 154(b) by 0 days.

(21) Appl. No.: 18/038,104

(22) PCT Filed: Dec. 3, 2021

(86) PCT No.: PCT/IB2021/061293
§ 371 (c)(1),
(2) Date: May 22, 2023

(87) PCT Pub. No.: WO2022/130102
PCT Pub. Date: Jun. 23, 2022

(65) Prior Publication Data

US 2024/0002993 A1 Jan. 4, 2024

(30) Foreign Application Priority Data

Dec. 16, 2020 (WO) ..... PCT/IB2020/062044

(51) Int. Cl.
*C23C 2/12* (2006.01)
*B21C 47/02* (2006.01)
(Continued)

(52) U.S. Cl.
CPC ..... *C23C 2/12* (2013.01); *B21C 47/02* (2013.01); *C21D 1/02* (2013.01); *C21D 1/673* (2013.01);
(Continued)

(58) Field of Classification Search
None
See application file for complete search history.

(56) References Cited

U.S. PATENT DOCUMENTS

2015/0294754 A1 10/2015 Ohata et al.
2016/0017452 A1 1/2016 Puerto Velasquez et al.
(Continued)

FOREIGN PATENT DOCUMENTS

CN 106574348 4/2017
CN 109371325 A 2/2019
(Continued)

OTHER PUBLICATIONS

Search Report of PCT/IB2021/061291 of Mar. 14, 2022 and International Report on Patentability.
(Continued)

*Primary Examiner* — Daniel J. Schleis
(74) *Attorney, Agent, or Firm* — Davidson Kappel LLC

(57) ABSTRACT

A coated steel sheet and press hardened steel part having a composition including, by weight percent: C 0.15-0.25%, Mn 0.5-1.8%, Si 0.1-1.25%, Al 0.01-0.1%, Cr 0.1-1.0%, Ti 0.01-0.1%, B 0.001-0.004%, P≤0.020%, S≤0.010%, N≤0.010% the remainder of the composition being iron and unavoidable impurities resulting from the smelting. The press hardened steel part includes a bulk having a microstructure including, in surface fraction, more than 95% of martensite and less than 5% of bainite, a coating layer at the surface of the steel part, a ferritic interdiffusion layer between the coating layer and the bulk, and a ratio between the ferritic grain width in the interdiffusion layer $GW_{int}$ over prior austenite grain size in the bulk $PAGS_{bulk}$, satisfying following equation $(GW_{int}/PAGS_{bulk})-1 \geq 30\%$.

7 Claims, 5 Drawing Sheets

Trial 4
Coated steel sheet

1: Coating
2: Bulk: Microstructure of ferrite + pearlite, or bainite or M-A islands

(51) Int. Cl.

| | |
|---|---|
| ***C21D 1/02*** | (2006.01) |
| ***C21D 1/673*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/28*** | (2006.01) |
| ***C22C 38/32*** | (2006.01) |
| ***C22C 38/38*** | (2006.01) |
| ***C23C 2/02*** | (2006.01) |
| ***C23C 2/28*** | (2006.01) |
| ***C23C 2/40*** | (2006.01) |
| ***C23G 1/08*** | (2006.01) |

(52) U.S. Cl.

CPC ..... *C21D 8/0226* (2013.01); *C21D 8/0257* (2013.01); *C21D 8/0263* (2013.01); *C21D 8/0273* (2013.01); *C21D 8/0278* (2013.01); *C22C 38/001* (2013.01); *C22C 38/002* (2013.01); *C22C 38/02* (2013.01); *C22C 38/06* (2013.01); *C22C 38/28* (2013.01); *C22C 38/32* (2013.01); *C22C 38/38* (2013.01); *C23C 2/02* (2013.01); *C23C 2/0224* (2022.08); *C23C 2/024* (2022.08); *C23C 2/29* (2022.08); *C23C 2/40* (2013.01); *C23G 1/08* (2013.01); *C21D 2211/001* (2013.01); *C21D 2211/002* (2013.01); *C21D 2211/005* (2013.01); *C21D 2211/008* (2013.01)

(56) References Cited

U.S. PATENT DOCUMENTS

| | | | | |
|---|---|---|---|---|
| 2016/0362763 | A1 | 12/2016 | Oh et al. | |
| 2017/0253941 | A1 | 9/2017 | Cobo et al. | |
| 2017/0260599 | A1* | 9/2017 | Puerta Velasquez | B32B 15/013 |
| 2018/0237877 | A1 | 8/2018 | Wange et al. | |
| 2019/0106759 | A1 | 4/2019 | Kohsaka et al. | |
| 2019/0390295 | A1 | 12/2019 | Nakagawa et al. | |
| 2020/0087747 | A1 | 3/2020 | Kim et al. | |
| 2020/0190621 | A1* | 6/2020 | Cobo | C21D 8/0263 |
| 2020/0392596 | A1 | 12/2020 | Alibeigi et al. | |

FOREIGN PATENT DOCUMENTS

| | | | |
|---|---|---|---|
| CN | 111448329 | | 7/2020 |
| JP | 2010043323 | A | 2/2010 |
| JP | 2016504488 | A | 2/2016 |
| JP | 2020-509203 | A | 3/2020 |
| WO | WO2014188830 | A1 | 11/2014 |
| WO | WO2016104881 | A1 | 6/2016 |
| WO | WO2017006159 | A1 | 1/2017 |
| WO | WO2018179839 | A1 | 10/2018 |
| WO | WO2018220540 | A1 | 12/2018 |
| WO | WO2019171157 | A1 | 9/2019 |
| WO | WO2022130101 | A1 | 6/2022 |
| WO | WO 2022130102 | A1 | 6/2022 |

OTHER PUBLICATIONS

Search Report of PCT/IB2021/061293 of Mar. 14, 2022 and International Report on Patentability.

Meyer et al.: «Optimierung der Werkstoffeigenschaften bei der Herstellung von Warmband und Kaltband aus Stahl,» Stahl-Eisen, 1988 Verlag Stahleisen mbH Duesseldorf, see partial translation.

* cited by examiner

Trial 4
Coated steel sheet

1: Coating
2: Bulk: Microstructure of ferrite + pearlite, or bainite or M-A islands Trial 4
Press hardened steel part

5: Coating
6: Interdiffusion layer : with grain width equivalent to the grain size in the bulk
7: Bulk 100% Martensite Trial 5
Coated steel sheet

1: Coating
2: Bulk. Microstructure of ferrite + pearlite, or ferrite + bainite or ferrite + M-A islands
3: Decarburized layer Trial 5
Press hardened steel part

5: Coating
6: Interdiffusion layer : with grain width equivalent to the grain size in the bulk
7: Bulk 100% Martensite Trial 2
Coated steel sheet

1: Coating
2: Bulk. Microstructure of ferrite + pearlite, or ferrite + bainite or ferrite + M-A islands
3: Decarburized layer comprising in upper part a ferrite layer (4). Grain size of ferrite is wider than in the bulk.

Trial 2
Press hardened steel part

5: Coating
6: Interdiffusion layer : Grain width larger than in the bulk
7: Bulk 100% Martensite

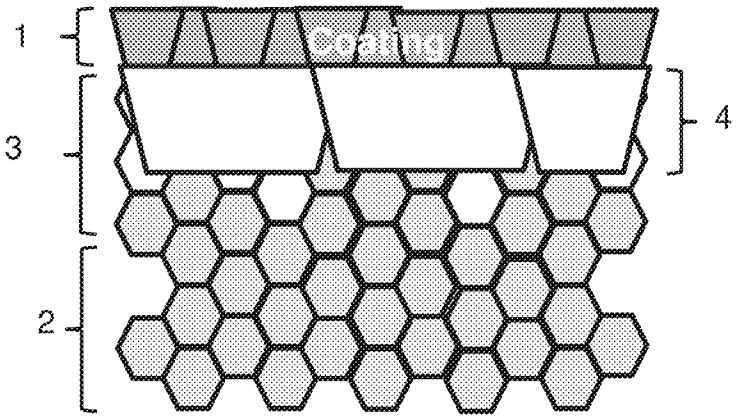

Fig 4a

Trial 3
Coated steel sheet

1: Coating
2: Bulk. Microstructure of ferrite + pearlite, or ferrite + bainite or ferrite + M-A islands
3: Decarburized layer comprising in upper part a ferrite layer (4). Grain size of ferrite is wider than in the bulk.

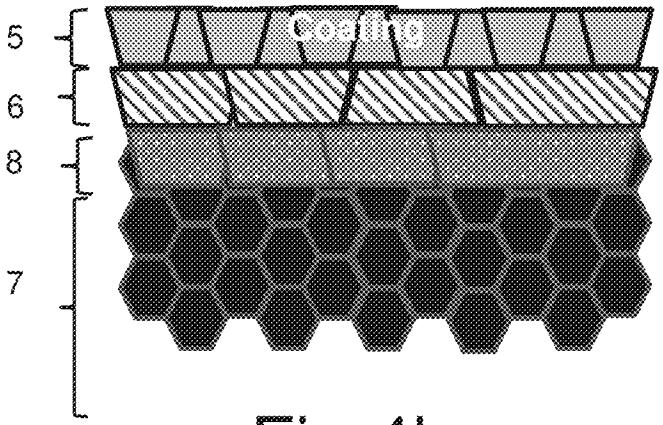

Fig 4b

Trial 3
Press hardened steel part

5: Coating
6: Interdiffusion layer : Grain width larger than in the bulk
7: Bulk 100% Martensite
8: Layer of martensite with a gradient of carbon

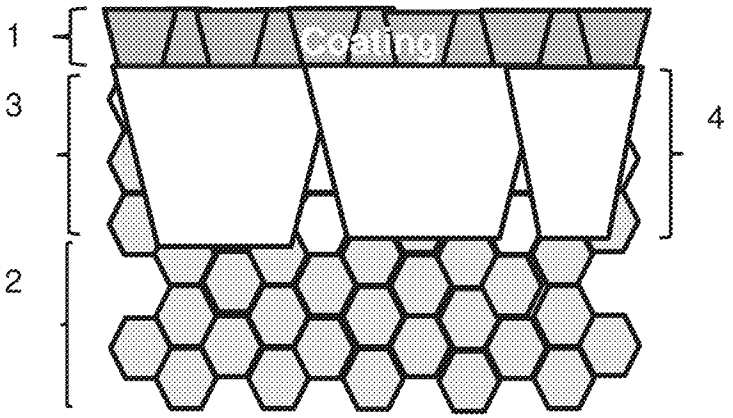

Fig 5a

Trial 9
Coated steel sheet

1: Coating Al-Si
2: Bulk. Microstructure of ferrite + pearlite, or ferrite + bainite or ferrite + M-A islands
3: Decarburized layer with a deep surface ferrite layer (4). Grain size of ferrite is wider than in the bulk.

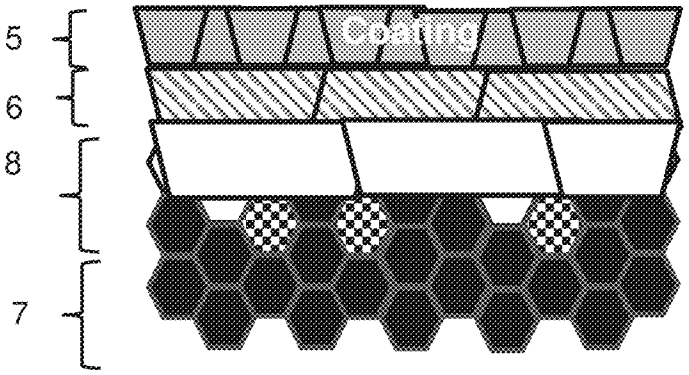

Fig 5b

Trial 9
Press hardened steel sheet

5: Coating Al-Si
6: Interdiffusion layer : Grain width larger than in the bulk
7: Bulk 100% martensitic
8: multiphase layer topped by ferrite layer

COATED STEEL SHEET AND HIGH STRENGTH PRESS HARDENED STEEL PART AND METHOD OF MANUFACTURING THE SAME

The present invention relates to coated steel sheets and to high strength press hardened steel parts having good bendability properties.

High strength press-hardened parts can be used as structural elements in automotive vehicles for anti-intrusion or energy absorption functions.

BACKGROUND

In such type of applications, it is desirable to produce steel parts that combine high mechanical strength, high impact resistance and good corrosion resistance. Moreover, one of major challenges in the automotive industry is to decrease the weight of vehicles in order to improve their fuel efficiency in view of the global environmental conservation, without neglecting the safety requirements.

This weight reduction can be achieved in particular thanks to the use of steel parts with a martensitic or bainitic/martensitic microstructure.

SUMMARY OF THE INVENTION

The publication WO2016104881 relates to a hot press forming part used as a structural part of a vehicle or the like, requiring impact resistance characteristics, and more particularly, having a tensile strength of 1300 MPa or greater and a method for manufacturing the same by heating a steel material to a temperature at which an austenite single phase may be formed, and quenching and hot forming thereof using a mold. To obtain such properties, the base steel sheet comprises a thin ferrite layer lower than 50 μm at the surface, and the carbides size and density should be controlled. This ferrite layer in the substrate allow to inhibit the propagation of the fine cracks formed on the plating layer to the base but leads to a low bendability with bending angle lower than 70°.

The publication WO2018179839 relates to a hot-pressed part obtained by hot pressing a steel sheet having a microstructure changing in the thickness direction, with a soft layer made of at least 90% of ferrite, a transition layer made of ferrite and martensite and a hard layer mainly martensitic and has both high strength and high bendability. To obtain such properties, the cold rolled steel sheet is annealed in an atmosphere with a dew point temperature comprises from 50° C. to 90° C., which could be harmful to aluminum alloy coating.

An object of the invention is to solve the above-mentioned problem and to provide a press hardened steel part having a combination of high mechanical properties with the tensile strength TS above or equal to 1350 MPa and bending angle higher than 70°. Preferably, the press hardened steel part according to the invention has yield strength YS above or equal to 1000 MPa.

Another purpose of the invention is to obtain a coated steel sheet that can be transformed by hot forming into such a press hardened steel part.

The present invention provides a coated steel sheet made of a steel having a composition comprising, by weight percent:

C: 0.15-0.25%
Mn: 0.5-1.8%
Si: 0.1-1.25%

Al: 0.01-0.1%
Cr: 0.1-1.0%
Ti: 0.01-0.1%
B: 0.001-0.004%
P≤0.020%
S≤0.010%
N≤0.010%
and comprising optionally one or more of the following elements, by weight percent:
Mo≤0.40%
Nb≤0.08%
Ca≤0.1%
the remainder of the composition being iron and unavoidable impurities resulting from the smelting,
said coated steel sheet comprising from the bulk to the surface of the coated steel sheet:
a bulk with a microstructure comprising, in surface fraction, from 60% to 90% of ferrite, the rest being martensite-austenite islands, pearlite or bainite,
such bulk being topped by a decarburized layer comprising in upper part a ferrite layer having a thickness from 1 μm to 100 μm
a coating layer made of aluminum or aluminum alloy.

A method and a part are also provided.

BRIEF DESCRIPTION OF THE DRAWINGS

The invention will now be described in detail and illustrated by examples without introducing limitations, with reference to the appended figures:

FIG. 4*a* illustrates a schematic section of the coated steel sheet of trial 3, which is according to the invention FIG. 4*b* represents a schematic section of the press hardened steel part from trial 3 which is according to the invention FIG. 5*a* illustrates a schematic section of the coated steel sheet of trial 9, which is not according to the invention FIG. 5*b* represents a schematic section of the press hardened steel part from trial 9 which is not according to the invention.

DETAILED DESCRIPTION

Figure 1A:
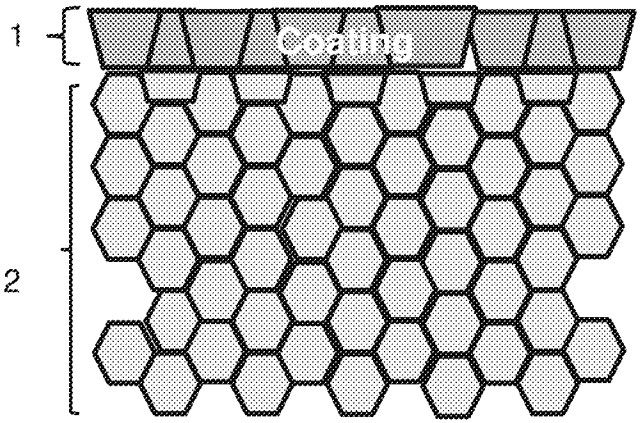
FIG. 1*a* illustrates a schematic section of the coated steel sheet of trial 4, which is not according to the invention

The composition of the steel according to the invention will now be described, the content being expressed in weight percent.

According to the invention the carbon content is comprised from 0.15% to 0.25% to ensure a satisfactory strength. Above 0.25% of carbon, weldability and bendability of the steel sheet may be reduced. If the carbon content is lower than 0.15%, the tensile strength will not reach the targeted value.

The manganese content is comprised from 0.5% to 1.8%. Above 1.8% of addition, the risk of central segregation increases to the detriment of the bendability. Below 0.5% the hardenability of the steel sheet is reduced. Preferably the manganese content is comprised from 0.8% to 1.5%.

According to the invention, silicon content is comprised from 0.1% to 1.25%. Silicon is an element participating in the hardening in solid solution. Silicon is added to limit carbides formation. Above 1.25%, silicon oxides form at the surface, which impairs the coatability of the steel. Moreover, the weldability of the steel sheet may be reduced. Preferably, the silicon content is from 0.2% to 1.25%. More preferably the silicon content is from 0.3% to 1.25%.

The aluminum content is comprised from 0.01% and 0.1% as it is a very effective element for deoxidizing the steel in the liquid phase during elaboration. Aluminum can protect boron if titanium content is not enough. The aluminum content is lower than 0.1% to avoid oxidation problems and ferrite formation during press hardening. Preferably the aluminum content is comprised from 0.01% to 0.05%.

According to the invention, the chromium content is comprised from 0.1% to 1.0%. Chromium is an element participating in the hardening in solid solution and must be higher than 0.1%. The chromium content is below 1.0% to limit processability issues and cost.

The titanium content is comprised from 0.01% to 0.1% in order to protect boron from formation of BN. Titanium content is limited to 0.1% to avoid TiN formation.

According to the invention, the boron content is comprised from 0.001% to 0.004%. Boron improves the hardenability of the steel. The boron content is not higher than 0.004% to avoid a risk of breaking the slab during continuous casting.

Some elements can optionally be added.

Molybdenum content can optionally be added up to 0.40%. As boron, molybdenum improves the hardenability of the steel. Molybdenum is not higher than 0.40% to limit cost.

According to the invention, niobium can optionally be added up to 0.08% to improve ductility of the steel. Above 0.08% of addition, the risk of formation of NbC or Nb(C,N) carbides increases to the detriment of the bendability. Preferably the niobium content is below or equal to 0.05%.

Calcium may be also added as an optional element up to 0.1%. Addition of Ca at the liquid stage makes it possible to create fine oxides which promote castability of continuous casting.

The remainder of the composition of the steel is iron and impurities resulting from the smelting. In this respect, P, S and N at least are considered as residual elements which are unavoidable impurities. Their content is less than 0.010% for S, less than 0.020% for P and less than 0.010% for N.

The microstructure of the coated steel sheet according to the invention will now be described.

Figure 3A:
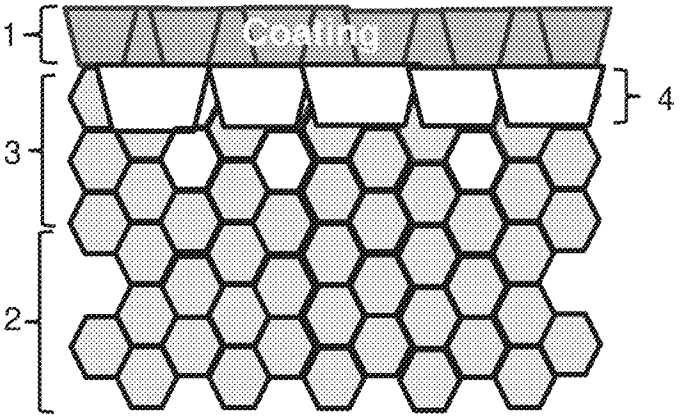
FIG. 3*a* illustrates a schematic section of the coated steel sheet of trials 1 and 2, which are according to the invention

A section of a coated steel sheet of the invention is schematically represented on FIG. 3*a* and FIG. 4*a*. The coated steel sheet comprises a bulk (2) topped by a decarburized layer (3) comprising in upper part a ferrite layer having a thickness from 1 μm to 100 μm (4), and a coating layer (1). Preferably, the thickness of the ferrite layer is comprised from 20 μm to 100 μm. More preferably, the thickness of the ferrite layer is from 25 μm to 100 μm. More preferably the thickness of the ferrite layer is from 25 μm to 80 μm.

The bulk of the coated steel sheet (2) has a microstructure comprising, in surface fraction, from 60% to 90% of ferrite, the rest being martensite-austenite islands, pearlite or bainite.

This ferrite is formed during the intercritical annealing of the cold rolled steel sheet. The rest of the microstructure is austenite at the end of the soaking, which transform into martensite-austenite islands, pearlite or bainite during the cooling of the steel sheet.

The decarburized layer present on top of the bulk is obtained during the annealing of the cold rolled steel sheet thanks to the control of the atmosphere in the furnace to set a dew point temperature strictly higher than −10° C. and below or equal to 20° C.

The coated steel sheet according to the invention can be produced by any appropriate manufacturing method and the man skilled in the art can define one. It is however preferred to use the method according to the invention comprising the following steps:

A semi-product able to be further hot-rolled, is provided with the steel composition described above. The semi product is reheated at a temperature comprised from 1150° C. to 1300° C.

The steel sheet is then hot rolled at a finish hot rolling temperature comprised from 800° C. to 950° C.

The hot-rolled steel is then cooled and coiled at a temperature $T_{coil}$ lower than 670° C., and optionally pickled to remove oxidation.

The coiled steel sheet is then optionally cold rolled to obtain a cold rolled steel sheet. The cold-rolling reduction ratio is preferably comprised from 20% to 80%. Below 20%, the recrystallization during subsequent heat-treatment is not favored, which may impair the ductility of the steel sheet. Above 80%, there is a risk of edge cracking during cold-rolling.

The steel sheet is then annealed in an HNx atmosphere with from 0% to 15% of H2, to an annealing temperature $T_A$ comprised from 700° C. to 850° C. and maintained at said annealing temperature $T_A$ for a holding time $t_A$ comprised from 10 s to 1200 s, in order to obtain an annealed steel sheet. Below 700° C., the kinetic of formation of the decarburized layer is too slow to obtain a ferrite layer in its upper part. The holding time $t_A$ is above or equal to 10 s to allow the ferrite layer to form, and below or equal to 1200 s in order to limit the thickness of this ferrite layer.

During this annealing, the atmosphere in the furnace is controlled to have a dew point temperature $T_{DP1}$ strictly higher than −10° C. and below or equal to +20° C. in order to form a decarburized layer according to the invention. If $T_{DP1}$ is below or equal to −10° C., the formation of the decarburized layer is slowed down and the ferrite layer is not formed in its upper part. The bendability of the steel part will be too low. If $T_{DP1}$ is higher than 20° C., the surface of the steel sheet may be completely oxidized, impairing coatability and mechanical properties of the sheet.

In an embodiment of the invention the annealed steel sheet is heated to an annealing temperature T2 comprised from 700° C. to 850° C. and maintained at said temperature T2 for a holding time t2 comprised from 10 s to 1200 s, the atmosphere having a dew point $T_{DP2}$ strictly higher than −10° C. and below or equal to +20° C.

The steel sheet is then coated with an aluminum alloy coating.

The microstructure of the press hardened steel part according to the invention will now be described. A section of the press hardened steel part is schematically represented on FIG. 3*b* and FIG. 4*b*.

The steel part comprises successively from the bulk to the surface of the steel part:

a bulk (7) having a microstructure comprising, in surface fraction, more than 95% of martensite and less than 5% of bainite, a ferritic interdiffusion layer (6), a coating layer (5) based on aluminum.

During the heating of the steel blank cut out of the steel sheet according to the invention, all microstructural elements of the bulk are transformed into austenite, and the ferrite of the decarburized layer is transformed into austenite with wider grain size than the austenite of the bulk. After hot forming, the steel part is then die-quenched. The interdiffusion layer grows from the former wide grain size austenite layer, thus having larger grain width than prior austenitic grain size in the bulk. The ratio between the ferritic grain width in the interdiffusion layer $GW_{int}$ over prior austenite grain size in the bulk $PAGS_{bulk}$, satisfies following equation:

$$(GW_{int}/PAGS_{bulk})-1 \geq 30\%$$

in order to improve bendability of the steel sheet, without deteriorating mechanical properties. The ferritic grain width is the average distance between two parallel grain boundaries, grain boundaries being oriented in the direction of the thickness of the sheet. The combination of annealing temperature $T_A$, annealing time $t_A$ and dew point temperature $T_{DP1}$ according to the invention allow to obtain large grain width in the interdiffusion layer. Moreover, the heating of the steel blank before the press forming, allow to obtain small PAGS in the bulk.

In an embodiment, the press hardened steel part may further comprise a martensite layer with a carbon gradient between the bulk and the interdiffusion layer, as represented by (8) in FIG. 4*b*. During the heating of the steel blank, carbon diffuses from the bulk to the surface. The ferrite upper part of the decarburized layer is then transformed in a layer of austenite with a gradient of carbon. During the die-quenching, this layer of austenite with a gradient of carbon is transformed in a layer of martensite with a carbon gradient.

The press hardened steel part according to the invention has a tensile strength TS above or equal to 1350 MPa and a bending angle higher than 70°. The bending angle has been determined on press hardened parts according to the method VDA238-100 bending Standard (with normalizing to a thickness of 1.5 mm).

In a preferred embodiment of the invention, the yield strength YS is above or equal to 1000 MPa.

TS and YS are measured according to ISO standard ISO 6892-1.

The press hardened steel part according to the invention can be produced by any appropriate manufacturing method and the man skilled in the art can define one. It is however preferred to use the method according to the invention comprising the following steps:

A coated steel sheet according to the invention is cut to a predetermined shape to obtain a steel blank. The steel blank is then heated to a temperature comprised from 880° C. to 950° C. during 10 s to 900 s to obtain a heated steel blank. The heated blank is then transferred to a forming press before being hot formed and die-quenched.

The invention will be now illustrated by the following examples, which are by no way limiting.

Example 7 grades, which compositions are gathered in table 1, were cast in semi-products and processed into steel sheets, then steel parts, following the process parameters gathered in table 2.

The tested compositions are gathered in the following table wherein the element contents are expressed in weight percent.

TABLE 1

| | Compositions | | | | | | | | | | | |
|---|---|---|---|---|---|---|---|---|---|---|---|---|
| Steel | C | Mn | Si | Al | Cr | Nb | Ti | B | Mo | P | S | N |
| A | 0.18 | 1.00 | 0.7 | 0.02 | 0.82 | 0.03 | 0.03 | 0.003 | 0.20 | 0.012 | 0.001 | 0.005 |
| B | 0.17 | 1.01 | 1.0 | 0.03 | 0.52 | 0.03 | 0.03 | 0.003 | 0.20 | 0.001 | 0.001 | 0.005 |
| C | 0.21 | 1.20 | 0.3 | 0.02 | 0.15 | — | 0.04 | 0.002 | 0.02 | 0.012 | 0.002 | 0.006 |
| D | 0.23 | 1.20 | 0.3 | 0.03 | 0.20 | — | 0.04 | 0.003 | — | 0.012 | 0.002 | 0.006 |
| E | 0.14 | 1.19 | 0.2 | 0.05 | 0.48 | — | 0.03 | 0.002 | 0.32 | 0.006 | 0.001 | 0.006 |
| F | 0.08 | 1.59 | 0.4 | 0.04 | 0.06 | 0.05 | 0.02 | 0.004 | — | 0.010 | 0.002 | 0.006 |
| G | 0.33 | 0.60 | 0.5 | 0.03 | 0.33 | 0.05 | 0.01 | 0.003 | 0.17 | 0.013 | 0.001 | 0.004 |

Steels A-D are according to the invention.

Underlined values: not corresponding to the invention

TABLE 2

| | | Process parameters | | | | | |
|---|---|---|---|---|---|---|---|
| | | Soaking | | | Second soaking | | |
| Trial | Steel | $t_A$ (s) | $T_A$ (° C.) | $T_{DP1}$ (° C.) | $t_2$ (s) | $T_2$ (° C.) | $T_{DP2}$ (° C.) |
| 1 | A | 90 | 800 | 0 | — | — | — |
| 2 | B | 90 | 800 | 0 | — | — | — |
| 3 | C | 135 | 850 | +10 | 70 | 800 | 0 |
| 4 | A | 90 | 800 | −30 | — | — | — |
| 5 | D | 160 | 805 | −10 | — | — | — |
| 6 | E | 105 | 730 | −35 | — | — | — |
| 7 | E | 105 | 730 | −10 | — | — | — |
| 8 | F | 240 | 770 | −8 | — | — | — |
| 9 | C | 3600 | 700 | −10 | — | — | — |
| 10 | G | 30 | 730 | −40 | | | |

Underlined values: not corresponding to the invention

Steel semi-products, as cast, were reheated at 1200° C., hot rolled with a finish hot rolling temperature comprised from 800 to 950° C., coiled at 550° C. and cold rolled with a reduction rate of 60%. Steel sheets are then heated to a temperature $T_A$ and maintained at said temperature for a holding time $t_A$, in an HNx atmosphere with 5% of $H_2$, having a controlled dew point. The steel sheets were then cooled down to a temperature from 560 to 700° C. and then hot dip coated with an aluminum-silicon coating comprising 10% of silicon.

Sample 3 did undergo a second annealing at a temperature $T_2$_before coating, the steel sheet being maintained at said $T_2$ temperature for a holding time $t_2$, in an HNx atmosphere with 5% of $H_2$ and a controlled dew point. The following specific conditions were applied:

The coated steel sheets were analyzed, and the corresponding properties of decarburized layer are gathered in table 3.

TABLE 3

Properties of the decarburized layer of the coated steel sheet

| Trial | Presence of decarburized layer | Thickness of the ferrite upper part of the decarburized layer (μm) |
|---|---|---|
| 1 | Yes | 35 |
| 2 | Yes | 30 |
| 3 | Yes | 60 |
| 4 | No | — |
| 5 | Yes | — |
| 6 | No | — |
| 7 | Yes | 25 |
| 8 | Yes | — |
| 9 | Yes | 130 |
| 10 | No | — |

Underlined values: not corresponding to the invention

The coated steel sheets were then cut to obtain a steel blank, heated at 900° C. during 6 minutes and hot-formed. The steel parts were analyzed and the corresponding microstructure, ferritic grain width in interdiffusion layer $GW_{int}$, and prior austenite grain size in the bulk $PAGS_{bulk}$ are gathered in table 4. Mechanical properties are gathered in Table 5.

TABLE 4

Microstructure of the press hardened steel part

| Trial | Bulk microstructure | $(GW_{int}/PAGS_{bulk}) - 1$ | $GW_{int}$ (μm) | $PAGS_{bulk}$ (μm) |
|---|---|---|---|---|
| 1 | 100% martensite | 39% | 7.1 | 5.1 |
| 2 | 100% martensite | 91% | 8.8 | 4.6 |
| 3 | 100% martensite | 45% | 11.3 | 7.8 |
| 4 | 100% martensite | 7% | 4.7 | 4.4 |
| 5 | 100% martensite | 17% | 8.8 | 7.5 |
| 6 | 100% martensite | 100% | 9.0 | 4.5 |
| 7 | 100% martensite | 141% | 13.5 | 5.6 |
| 8 | 100% martensite | 44% | 6.5 | 4.5 |
| 9 | 20% ferrite<br>50% bainite<br>30% martensite | n.d | 14.1 | n.d |
| 10 | 100% martensite | −2% | 4.9 | 5.0 |

Underlined values: not corresponding to the invention
n.d: non determined

The surface fractions, ferritic grain width in the interdiffusion layer and PAGS are determined through the following method: a specimen is cut from the press hardened steel part, polished and etched with a reagent known per se, to reveal the microstructure. The section is afterwards examined through optical or scanning electron microscope, for example with a Scanning Electron Microscope with a Field Emission Gun ("FEG-SEM") at a magnification greater than 5000×, coupled to a BSE (Back Scattered Electron) device.

Mechanical properties of the tested samples were determined and gathered in the following table:

TABLE 5

Mechanical properties of the press hardened steel part

| Trial | TS (MPa) | Bending angle at 1.5 mm (°) | YS (MPa) |
|---|---|---|---|
| 1 | 1413 | 83 | 1121 |
| 2 | 1421 | 86 | 1136 |
| 3 | 1427 | 89 | 1141 |
| 4 | 1461 | 64 | 1168 |
| 5 | 1460 | 59 | 1066 |
| 6 | 1281 | 79 | 1058 |
| 7 | 1269 | 96 | 1054 |
| 8 | 1100 | 99 | 920 |
| 9 | 1300 | 74 | 894 |
| 10 | 1917 | 42 | 1527 |

Underlined values: do not match the targeted values

The examples show that the steel parts according to the invention, namely examples 1-3 are the only one to show all the targeted properties thanks to their specific compositions and microstructures.

FIG. 3*a* represents a schematic section of the coated steel sheet of trials 1 and 2. The combination of process parameters of the invention, annealing temperature $T_A$, annealing time $t_A$ and dew point temperature $T_{DP1}$ allow to obtain a decarburized layer (3), in which a layer of ferrite is formed in the upper part (4).

Figure 3B:
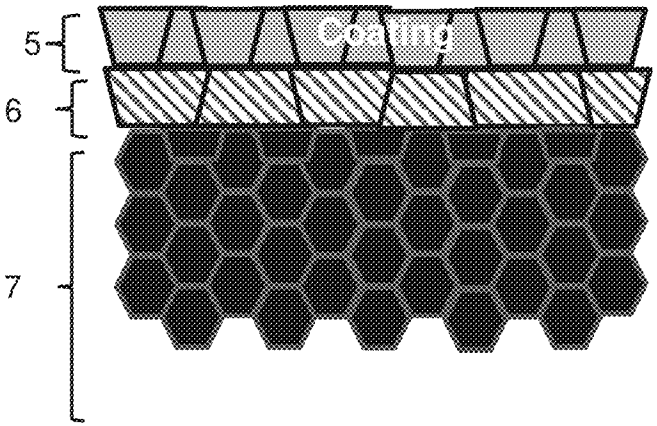
FIG. 3*b* represents a schematic section of the press hardened steel part from trials 1 and 2 which are according to the invention

The coated steel sheet is then hot formed. FIG. 3*b* represents a schematic section of the press hardened steel part of trials 1 and 2.

The grain width of ferrite formed in the interdiffusion layer (6) is a heritage of the pure ferrite layer in which austenite formation takes place during heating, with larger grain size. The interdiffusion layer grows on this large austenite grain size. The grain width of ferrite in the interdiffusion layer (6) is then larger than prior austenite grain size in the bulk (7), leading to good bendability with bending angle higher than 70°.

FIG. 4*a* represents a schematic section of the coated steel sheet of trial 3. The combination of process parameters of the invention, annealing temperature $T_A$, annealing time $t_A$ and dew point temperature $T_{DP1}$ lead to the formation of a decarburized layer (3), with in upper part a layer of ferrite (4), deeper than in trials 1 and 2 thanks to longer annealing time.

The coated steel sheet is then hot formed. FIG. 4*b* represents a schematic section of the press hardened steel from trial 3.

The grain size of ferrite in the interdiffusion layer (6) is a heritage of the pure ferrite layer in which austenite formation takes place during heating of the steel part, with larger grain size. The interdiffusion layer grows on these larger austenitic grain size. The ferritic grain width in the interdiffusion layer (6) is then larger than the prior austenite grain size in the bulk (7), leading to good bendability with bending angle higher than 70°. Moreover, due to the thick ferrite layer (3) in the coated steel sheet, a layer of martensite with a carbon gradient is formed between the bulk and the interdiffusion layer in the press hardened steel part, leading to tensile strength higher than 1350 MPa.

In trial 4, the composition of the steel sheet is the same as in trial 1 and according to the invention. By comparison with trial 1, the dew point temperature during annealing of the steel sheet is too low to obtain a decarburized layer with an upper ferrite part in the coated steel sheet. FIG. 1*a* represents a schematic section of the coated steel sheet of these trials, with the coating layer (1) and the bulk (2).

Figure 1B:
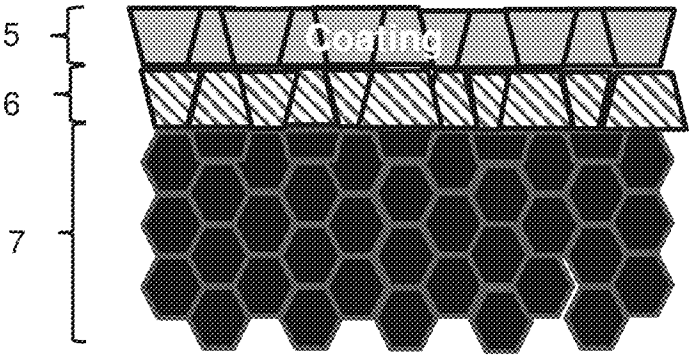
FIG. 1*b* represents a schematic section of the press hardened steel part from trial 4 which is not according to the invention

The coated steel sheet is then hot formed. FIG. 1*b* represents a schematic section of the press hardened steel part from trial 4. Due to the absence of the ferrite layer, the ferritic grain width in the interdiffusion layer (6) is then equivalent to prior austenite grain size in the bulk (7), leading to a low bending angle below 70°.

Figure 2A:
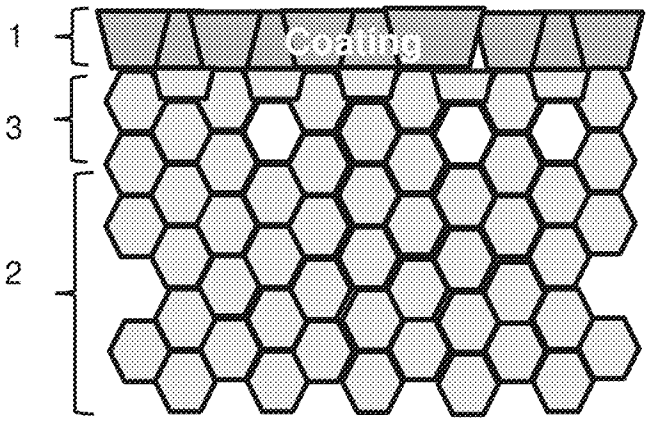
FIG. 2*a* illustrates a schematic section of the coated steel sheet of trial 5, which is not according to the invention

In trial 5, the coated steel sheet has a decarburized layer, without ferrite layer in the upper part, as represented schematically in FIG. 2*a*. The absence of ferrite layer is due to the low dew point temperature $T_{DP1}$ of −10° C., which slow down the kinetics of the decarburization.

Figure 2B:
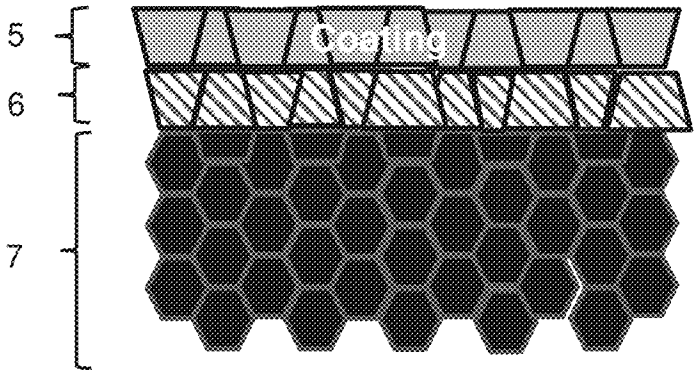
FIG. 2*b* represents a schematic section of the press hardened steel part from trial 5 which is not according to the invention

The coated steel sheet is then hot formed. FIG. 2*b* represents a schematic section of the press hardened steel part from trial 5. Due to the absence of the ferrite layer, the ferritic grain width in the interdiffusion layer (6) is then equivalent to prior austenite grain size in the bulk (7), leading to a low bending angle below 70°.

In trials 6 and 7, the steel sheet has a low level of carbon of 0.14%. In trial 6, the low dew point temperature $T_{DP1}$ of −35° C. does not allow to grow the decarburized layer and ferrite layer in the coated steel sheet. By comparison, in trial 7, the steel sheet is annealed at the same temperature and during the same time than trial 6, but with a dew point temperature of −10° C. This higher dew point temperature allows to obtain the decarburized layer, with a ferrite layer thanks to the low level of carbon of the steel sheet. But this low level of carbon does not allow to obtain desired mechanical properties on the press hardened steel part. In particular the tensile strength is below 1350 MPa.

In trial 8, the steel sheet has a low carbon level of 0.08%. This low carbon content combined to the process parameters, leads to a decarburized layer in the coated steel sheet without the ferrite layer. Nevertheless, the yield strength and tensile strength of the press hardened steel part are not achieved because of the low level of carbon.

In trial 9, the steel sheet is maintained during 3600 s at soaking temperature, which form in the coated steel sheet, a thicker ferrite layer in the decarburized layer than previous trials. FIG. 5*a* represents a schematic section of the coated steel sheet of trial 9, with the coating layer (1) the decarburized layer (3), the thicker ferrite layer (4) with coarser grain size, and the bulk (2).

The coated steel sheet is then hot formed and FIG. 5*b* represents a schematic section of the press hardened steel part from trial 9. During the heating of the steel part, the microstructure of the bulk is austenitic, and the thick ferrite layer is transformed in a layer of austenite with gradient of carbon. But due to the thickness of the ferrite layer higher than 100 μm, a layer of ferrite remains present between the interdiffusion layer and the layer of austenite with gradient of carbon.

During die quenching of the steel part, the ferrite layer is still present and the layer of austenite with carbon gradient transforms into a martensite layer with gradient of carbon, leading to a multi-phased layer. This triggers a decrease of yield strength and tensile strength.

In trial 10, steel sheet has a carbon content higher than 0.25%. The low dew point temperature $T_{DP1}$ of −40° C. does not allow the growth of a decarburized layer, leading to the absence of the ferrite layer in the coated steel sheet, and to a low bending angle below 70° in the press hardened part.

What is claimed is:

1. A coated steel sheet made of a steel having a composition comprising, by weight percent:

C: 0.15-0.25%
Mn: 0.5-1.8%
Si: 0.1-1.25%
Al: 0.01-0.1%
Cr: 0.1-1.0%
Ti: 0.01-0.1%
B: 0.001-0.004%
P≤0.020%
S≤0.010%
N≤0.010% and comprising optionally one or more of the following elements, by weight percent:

Mo≤0.40%
Nb≤0.08%
Ca≤0.1% a remainder of the composition being iron and unavoidable impurities resulting from processing;

the coated steel sheet comprising from a bulk to the surface of the coated steel sheet:

the bulk with a microstructure comprising, in surface fraction, from 60% to 90% of ferrite, a rest being martensite-austenite islands, pearlite or bainite, a decarburized layer topping the bulk and comprising in upper part a ferrite layer having a thickness from 1 μm to 100 μm; and a coating layer made of aluminum or aluminum alloy.

2. A method for producing a coated steel sheet, the method comprising the following successive steps:

casting a steel to obtain a slab, the steel having a composition comprising, by weight percent:

C: 0.15-0.25%
Mn: 0.5-1.8%
Si: 0.1-1.25%
Al: 0.01-0.1%
Cr: 0.1-1.0%
Ti: 0.01-0.1%
B: 0.001-0.004%
P≤0.020%
S≤0.010%
N≤0.010% and comprising optionally one or more of the following elements, by weight percent:

Mo≤0.40%
Nb≤0.08%
Ca≤0.1% a remainder of the composition being iron and unavoidable impurities resulting from processing;

reheating the slab at a temperature $T_{rehea}$t of 1100° C. to 1300° C.;

hot rolling the reheated slab at a finish hot rolling temperature of 800° C. to 950° C.;

coiling the hot rolled steel sheet at a coiling temperature T coil lower than 670° C. to obtain a coiled steel sheet;

optionally pickling the coiled steel sheet;

optionally cold rolling the coiled steel sheet to obtain a cold rolled steel sheet;

heating the hot rolled steel sheet or the cold rolled steel sheet to an annealing temperature $T_A$ of 700° C. to 850° C. and maintaining the steel sheet at the temperature $T_A$ for a holding time $t_A$ of 10 s to 1200 s, to obtain an annealed steel sheet, the atmosphere comprising from 0% to 15% of H2 and having a dew point Top1 strictly higher than −10° C. and below or equal to +20° C.;

cooling the annealed steel sheet to a temperature range from 560° C. to 700° C.;

coating the annealed steel sheet with aluminum or with an aluminum alloy coating; and cooling the coated steel sheet to room temperature.

3. A press hardened steel part, the steel part having a composition comprising, by weight percent:

C: 0.15-0.25%

Mn: 0.5-1.8%

Si: 0.1-1.25%

Al: 0.01-0.1%

Cr: 0.1-1.0%

Ti: 0.01-0.1%

B: 0.001-0.004%

P≤0.020%

S≤0.010%

N≤0.010% and comprising optionally one or more of the following elements, by weight percent:

Mo≤0.40%

Nb≤0.08%

Ca≤0.1% the remainder of the composition being iron and unavoidable impurities resulting from processing;

the steel part comprising successively from the bulk to the surface of the steel part:

a bulk having a microstructure comprising, in surface fraction, more than 95% of martensite and less than 5% of bainite, a ferritic interdiffusion layer, a coating layer based on aluminum, wherein a ratio between the ferritic grain width in the interdiffusion layer $GW_{int}$ over prior austenite grain size in the bulk $PAGS_{bulk}$, satisfies the following equation:

$$(GW_{int}/PAGS_{bulk})-1\geq 30\%.$$

4. The press hardened steel part as recited in claim 3 wherein the press hardened steel part includes a layer of martensite with a carbon gradient between the bulk and the ferritic interdiffusion layer.

5. The press hardened steel part as recited in claim 3 wherein the press hardened steel part has a tensile strength TS above or equal to 1350 MPa and a bending angle higher than 70°.

6. The press hardened steel part as recited in claim 5 wherein the press hardened steel part has a yield strength YS above or equal to 1000 MPa.

7. A process for manufacturing the press hardened steel part as recited in claim 5, the process comprising the following successive steps:

providing a steel sheet having the composition;

cutting the steel sheet to a predetermined shape, so as to obtain a steel blank;

heating the steel blank to a temperature of 880° C. to 950° C. for 10 s to 900 s to obtain a heated steel blank;

transferring the heated steel blank to a forming press;

hot-forming the heated blank in the forming press to obtain a formed part; and die-quenching the formed part.

* * * * *